United States Patent [19]

Shreiner et al.

[11] Patent Number: 5,048,249

[45] Date of Patent: Sep. 17, 1991

[54] GASKET FOR FLUSH EXPANSION JOINT COVER

[75] Inventors: Thomas A. Shreiner, Muncy; Paul Moulton, Williamsport, both of Pa.

[73] Assignee: Construction Specialties, Inc., Cranford, N.J.

[21] Appl. No.: 634,013

[22] Filed: Dec. 26, 1990

[51] Int. Cl.[5] ..... E04B 1/62; E01C 11/04

[52] U.S. Cl. ..... 52/403; 52/396; 404/64; 404/69

[58] Field of Search ..... 52/396, 402, 573, 403; 404/64, 65, 66, 67, 68, 69

[56] References Cited

U.S. PATENT DOCUMENTS

| | | | |
|---|---|---|---|
| 3,779,660 | 12/1973 | McGeary et al. | 404/69 |
| 4,007,994 | 2/1977 | Brown | 52/396 |
| 4,674,252 | 6/1987 | Nicholas et al. | 52/396 |
| 4,781,003 | 11/1988 | Rizza | 404/69 |
| 4,815,886 | 3/1989 | Madsen | 404/64 |

*Primary Examiner*—David A. Scherbel
*Assistant Examiner*—Michele A. Van Patten
*Attorney, Agent, or Firm*—Brumbaugh, Graves, Donohue & Raymond

[57] ABSTRACT

A gasket for a flush expansion joint cover comprises a longitudinally continuous central body portion and two longitudinally continuous side portions, one at either transverse edge of the central body portion. The central body portions and the side portions are comprised of a colorable thermoplastic rubber and are co-extruded to form an integral gasket structure. The side portions, which are adapted to keylock with mating grooves in structural members of the expansion joint cover, are harder than the central body portion to enhance retention of the gasket in place during use. The central body portion has a cellular core structure and a slightly concave upper surface to remain substantially smooth and flush with adjacent surfaces throughout the complete movement cycle of the expansion joint.

4 Claims, 2 Drawing Sheets

GASKET FOR FLUSH EXPANSION JOINT COVER

DESCRIPTION

BACKGROUND OF THE INVENTION

The present invention relates to expansion joint covers for bridging expansion gaps between adjacent floor, wall or ceiling sections and, more particularly, to a novel dual hardness thermoplastic rubber gasket for use in such expansion joint covers.

Over the years, many different types of expansion joint covers have been developed which embody one or more gaskets to establish a seal between the expansion joint cover components. The principal problem with this type of cover has been the ability to retain the gaskets in place within the expansion joint cover throughout the entire range of movement to which the cover is subjected during use. Dislocation of a gasket can result not only in the loss of seal integrity but also in the creation of a safety or maintenance hazard, particularly in floor joint applications. For like reasons, and also for purposes of appearance and ease of cleaning, it is important that the gasket present a smooth outer surface that is flush with the adjacent floor or wall sections. This is especially important, for example, in health care applications, where safety and ease of cleaning are crucial.

Other important features of expansion joint cover gaskets include durability, for long wear life and the capability of withstanding multidirectional loads, and replaceability, for ease of replacement in the event of damage or change in the decor of adjacent surfaces. To the latter end, it is also desirable that the gasket be composed of material which can be colored as desired.

The novel dual hardness thermoplastic rubber gasket of the present invention meets these and other requirements of the art.

SUMMARY OF THE INVENTION

There is provided, in accordance with the invention, a longitudinally continuous or elongated gasket for an expansion joint cover, which comprises in transverse cross section a central body portion and two side portions, one at either edge of the central body portion. Both the central body portion and the side portions are comprised of thermoplastic rubber and preferably are co-extruded to form an integral gasket structure. For purposes of providing a stronger attachment of the gasket to the structural members of the expansion joint cover, the side portions have a hardness value greater than the hardness value of the central body portion, which is made softer to accommodate movement of the expansion joint cover components during use.

The central body portion has a cellular core structure made up of a multiplicity of longitudinally extending cells defined by transversely spaced apart generally vertical walls and vertically spaced apart transverse upper and lower walls which interconnect the respective top and bottom edges of the vertical walls. The bottom wall of each cell preferably is formed in two upwardly converging angular wall sections which are adapted to fold in accordian-like fashion to accommodate transverse compression and expansion of the gasket. The upper wall of the central body portion is shaped to have a slightly concave upper surface when the gasket is in the relaxed, or uncompressed, state. This concave configuration of the upper wall surface of the central body portion, together with its cellular core structure, permit the gasket to remain flush with adjacent surfaces throughout the full design range of expansion joint movement.

Each side portion is generally U-shaped in cross section and is oriented to open downwardly. The transversely inner leg of each side portion forms the transversely outer vertical wall of the adjacent cell of the central body portion, and the transversely outer leg of each side portion is adapted to be keylocked into a mating longitudinally extending groove on a structural member of the expansion joint cover. To enhance the retentive forces acting between the outer leg and the groove, the outer leg may be provided with transversely and upwardly extending arrow-like ribs which impede dislodgment of the gasket leg from the groove.

To ensure uniform color of the exposed top surface of the gasket, it is desirable to include a side flange portion overlying each of the side portions, each side flange portion being of the same flexible thermoplastic rubber as that of the central body portion.

In a preferred embodiment, the gasket is formed by co-extrusion from "Santoprene" thermoplastic rubber, which is available commercially from the Monsanto Company. Representative hardness values are 55 Shore A for the central body portion and 87 Shore A for the side portions, although other durometers may produce similar functional characteristics.

DESCRIPTION OF THE DRAWINGS

For a better understanding of the invention, reference may be made to the following description of an exemplary embodiment thereof, taken in conjunction with the figures of the accompanying drawing, in which.

DESCRIPTION OF THE EMBODIMENT

Figure 1:
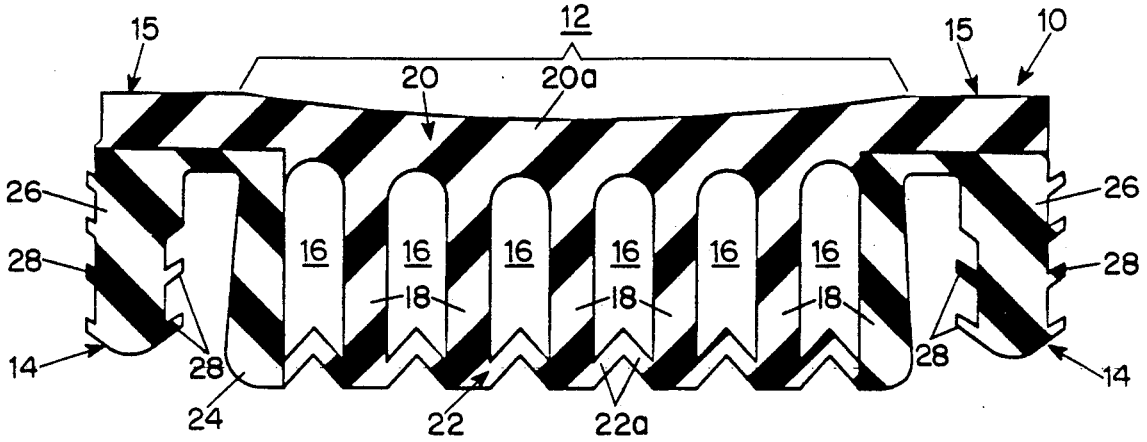
FIG. 1 is a transverse cross-sectional view of one embodiment of expansion joint cover gasket of the invention, showing the gasket in the relaxed (nominal) state.

In the exemplary embodiment shown in transverse cross section in FIG. 1, an expansion joint cover gasket 10 is comprised of a longitudinally continuous central body portion 12, two longitudinally continuous side portions 14, one at either transverse edge of the central body portion, and two longitudinally continuous side flange portions 15, one overlying each of the side portions. The central body portion 12, the side portions 14 and the side flange portions 15 are formed of an extrudable thermoplastic rubber, and preferably are co-extruded so as to form an integral structure. The gasket 10 is uniform in transverse cross section along its length and may be extruded in any desired length.

In accordance with the invention, the thermoplastic rubber forming the central body portion is sufficiently flexible to accommodate movement of the expansion joint in all directions. For that purpose, it suitably may have a hardness value of approximately 55 Shore A (ASTM D-2240). The thermoplastic rubber forming the side portions, by contrast, is more rigid than the material of the central body portion, and suitably may have a hardness value of approximately 87 Shore A (ASTM D-2240). The purpose of the harder side portions is to facilitate the establishment of firm locking engagement of the gasket to the structural members of the expansion joint cover, as is described more fully below, so as to retain the gasket flush and in place throughout the entire range of movement of the expansion joint, i.e., plus or minus 50% of the nominal width of the expansion gap.

The preferred material for the gasket 10 is a thermoplastic rubber manufactured by Monsanto Company and sold commercially under the registered trademark Santoprene. In addition to having excellent physical properties, such material is also colorable, which enhances its utility and attractiveness from the aesthetic point of view. The colorability of the material, for example, allows the gasket to be color coordinated with and blend into adjacent surface finishes. Colorable Santoprene thermoplastic rubber is available in both general purpose grades and ultraviolet resistant (UV) grades. The UV grades are preferred where weather resistance is important. It will be understood that other co-extrudable colorable thermoplastic rubbers may be used if desired and where application conditions permit.

The side flange portions 15 are of the same flexible thermoplastic rubber compound as used in the central body portion 12. The side flange portions 15 of the embodiment are, however, optional, and the side portions 14 may extend upwardly to the upper surface of the gasket so that they laterally abut the central body portion 12 throughout their vertical extents. The side flange portions 15 are desirable, because they ensure uniformity of color and finish appearance of the entire exposed upper surface of the gasket.

Figure 2:
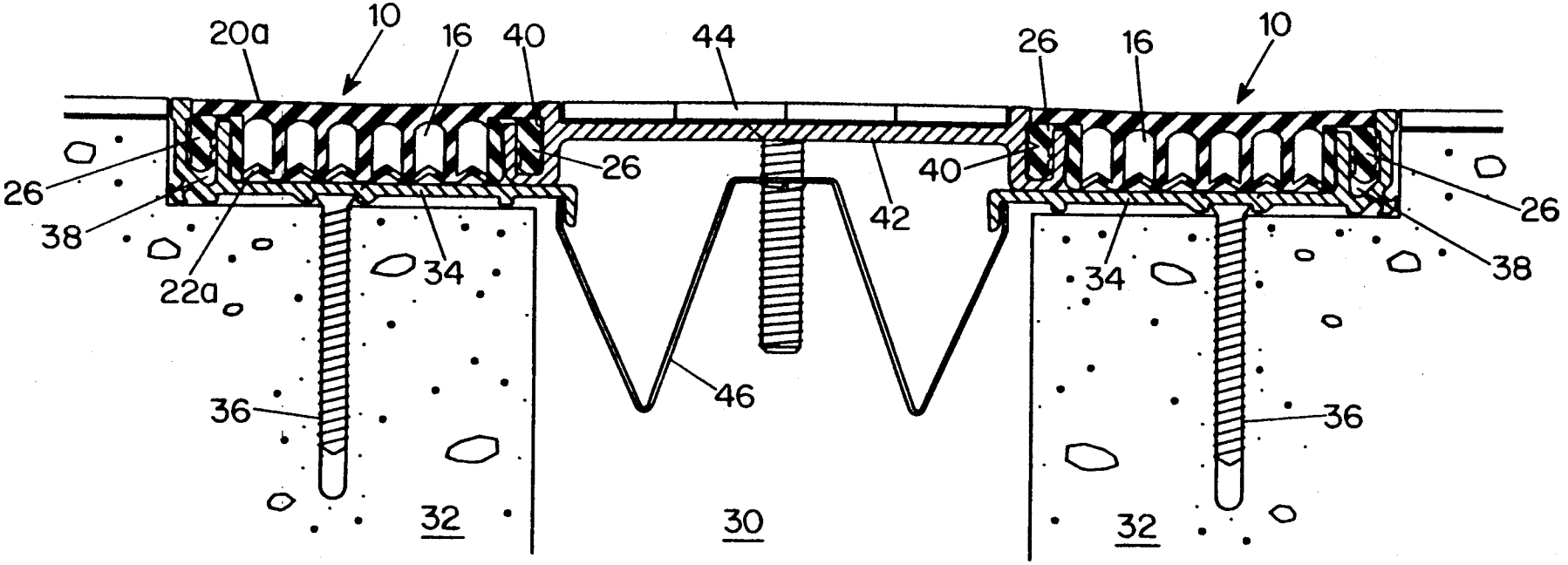
FIG. 2 is a transverse cross-sectional view of an expansion joint cover embodying the exemplary gasket of FIG. 1, showing the gasket in an expanded or stretched state.

FIG. 1 depicts the gasket 10 in the relaxed, uncompressed, state. In that state, the central body portion 12 consists of a multiplicity of longitudinally elongated, side-by-side hollow cells 16 which are defined in cross section by transversely spaced generally vertical walls 18 and vertically spaced apart transverse walls 20 and 22 interconnecting the respective upper and lower ends of the vertical walls 18. Between the adjacent vertical walls 18 of each cell 16, the bottom wall 22 has two upwardly converging angular wall sections **22*a* which fold into the space within the cell upon transverse compression of the gasket. FIG. 2** illustrates such transverse compression and folding of the bottom wall sections.

When in the relaxed state shown in FIG. 1, the upper surface **20*a* of the upper wall 20 preferably has a slight concave shape in transverse cross section. This configuration of the upper wall, together with the cellular core structure of the central body portion 12, permits the gasket 10** to remain substantially smooth and flush with the adjacent expansion joint components and/or building sections through the complete movement cycle.

Each side portion 14 of the gasket 10 is generally U-shaped in cross section and opens downwardly. The transversely inner leg 24 of each side portion forms the transversely outer vertical wall of the adjacent cell 16 of the central body portion 12. The transversely outer leg 26 of each side portion 14 is adapted to engage a corresponding groove (see FIG. 2) of a structural component of the expansion joint cover, as described below in connection with FIGS. 2–4, to lock the gasket in place on the cover. To that end, one or both transverse sides of each outer leg 26 may be formed with outwardly and upwardly extending, arrow-like ribs 28 to enhance the frictional engagement between the gasket and the cover component.

As noted above, the side portions 14 are harder than the central body portion 12 and preferably are sufficiently rigid to resist dislocation of the gasket from engagement with the structural components of the cover over the full range of movement of the expansion joint. By making the side portions 14 of a harder material than the central body portion 12, the side portions will better retain their shape during use, thereby facilitating the establishment and maintenance of a secure engagement to the cover, while at the same time allowing the central portion 12 to have the necessary flexibility to accommodate full range of movement of the cover components during use.

Figure 3:
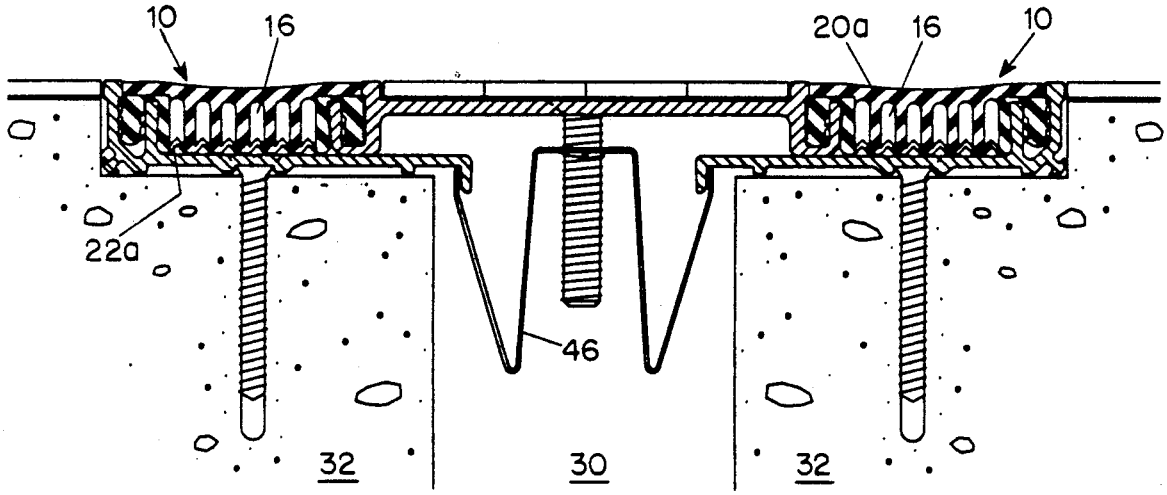
FIG. 3 is a transverse cross-sectional view of the expansion joint cover of FIG. 2, showing the gasket in the relaxed state.
Figure 4:
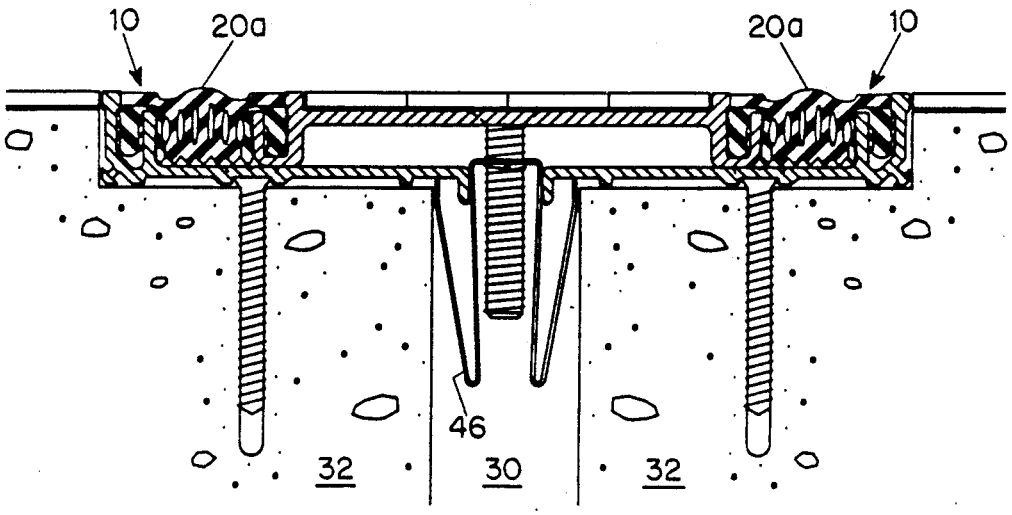
FIG. 4 is a transverse cross-sectional view of the expansion joint cover of FIG. 2, showing the gasket in the fully compressed state.

FIGS. 2–4 depict a floor-to-floor expansion joint cover in which a gasket 10 is located on either side of the expansion gap 30 between the floor sections 32. This is intended to be illustrative only, and it will be understood that a gasket need be located on only one side of the gap 30 and that the expansion joint cover could be used equally as well between wall-to-wall sections, ceiling-to-ceiling sections and floor (or ceiling)-to-wall sections. This type of expansion joint cover is described and illustrated in detail in U.S. Pat. No. 3,394,639, issued July 30, 1968, the disclosure of which is hereby incorporated by reference.

In the expansion joint cover of FIGS. 2–4, a frame member 34 is attached to the floor section 32 by a mansonry anchor 36. The frame member 34, as well as the other structural members of the cover, preferably comprises a continuous aluminum extrusion. At its transversely outer end, the frame member 34 is formed with an upwardly opening groove or channel 38 which receives the outer leg 26 of one side portion 14 of the gasket 10. The width of the groove 38 is preferably less than the transverse reach of the push-in ribs 28 of the gasket leg 26, so that the leg 26 must be forced into the groove 38 against the resistance of the ribs 28, thereby establishing a strong frictional engagement between the gasket 10 and the frame member 34. At its transversely inner end, the other side portion leg 26 of the gasket 10 is secured in a like manner to an upwardly opening groove or channel 40 formed at either end of a cover plate 42 which spans the expansion gap 30. In the form shown in FIGS. 2–4, the cover plate 42 is recessed on its upper side for receipt of tile, carpet or other floor or decorative finish material 44. The cover plate, together with the gasket 10 secured thereto, is held down against the upper surface of the frame member 34 by transversely expandible and contractible W-shaped stainless steel spring clips 46 which are bolted or otherwise suitably attached to the cover plate 42 at spaced intervals, e.g. 24 inches, along the length of the expansion joint. As described in U.S. Pat. No. 3,394,639, the W-shaped spring clips allow the expansion joint cover to accept full vertical shear movement as well as transverse expansion and contraction up to 50% of the nominal joint width. The novel gasket 10 of the present invention likewise accommodates such movement of the expansion joint.

FIGS. 2, 3 and 4 illustrate the gasket 10 in the fully stretched state, the relaxed, or nominal, state and the fully compressed state, respectively. In the fully stretched state of FIG. 2, the cells 16 are transversely expanded and the angular bottom wall segments **22*a* are flattened relative to their position in the relaxed state of FIG. 1. The upper surface 20***a* of the central portion 12 is also flattened, being somewhat less concave than in the relaxed state. As may be seen, the gasket 10 is essentially coplanar with the adjacent surfaces of the floor section 32 and the cover plate 42.

In the relaxed state of FIG. 3, the gasket assumes the configuration depicted in FIG. 1, with the central body upper surface 20*a* having a more concave configuration than in FIG. 2. However, the gasket is still substantially flush with the adjacent finished surfaces.

When fully compressed, as shown in FIG. 4, the surface 20*a* of the central body portion 12 dips slightly adjacent each transverse edge and rises slightly in the middle. On the whole, the gasket upper surface nonetheless remains substantially flush with the adjacent surfaces and presents no significant protuberance either above or below the floor level.

As may be seen from FIGS. 2–4, therefore, the gasket 10 retains a substantially flush relationship to the adjacent structural surfaces over the full range of expansion joint movement. The gasket thus provides a smooth, hygienic surface which facilitates cleaning and other maintenance tasks and which presents no significant hindrance or hazard to personnel traffic. This is especially important, for example, in health care facilities where ease of cleaning and safety are of paramount concern. Also, notwithstanding its secure attachment to the expansion joint cover, the gasket 10 is readily replaceable in the event of damage to the gasket or change in the color or decor of the surrounding building surfaces.

Although the invention has been described herein by reference to an illustrative embodiment and illustrative applications thereof, it will be understood that such embodiment and applications are susceptible of modification and variation without departing from the inventive concepts disclosed. All such modifications and variations, therefore, are intended to be encompassed within the spirit and scope of the appended claims.

We claim:

1. A gasket for a longitudinally elongated expansion joint cover, comprising:

a longitudinally elongated central body portion; and two longitudinally elongated side portions, one at either transverse edge of the central body portion, said central body portion and said side portions being composed of co-extruded thermoplastic rubber of different hardnesses, the hardness of the central body portion being less than the hardness of the side portions, so that the central body portion is sufficiently flexible to accommodate movement of the expansion joint cover and the side portions are sufficiently rigid to resist displacement of the gasket from engagement with members of the expansion joint cover, said central body portion including a multiplicity of longitudinally elongated side-by-side hollow cells defined in cross section by transversely spaced apart generally vertical walls and vertically spaced apart generally transverse walls interconnecting the respective top and bottom edges of adjacent vertical walls, the bottom wall of each cell having upwardly converging angularly related segments adapted to fold into the space within the cell upon transverse compression of the central body portion, said generally transverse upper wall of said central body portion having, at least when said central body portion in the relaxed state, a slightly concave upper surface, each of said side portions being generally U-shaped in transverse cross section and opening downwardly, with a upper closed end thereof having a generally flat upper surface which is generally flush with the adjacent upper surface of said central body portion, a transversely inner leg of each side portion forming a transversely outer vertical wall of the adjacent, cell of the central body portion and a transversely outer leg of each side portion being adapted to engage with a longitudinally elongated, upwardly opening groove in the expansion joint cover to retain the gasket in place on the cover.

2. The gasket of claim 1, wherein the hardness value of the central body portion is approximately 55 Shore A and the hardness of the side portions is approximately 87 Shore A.

3. The gasket of claim 1, wherein the outer leg of each side portion includes one or more outwardly and upwardly extending flexible ribs for enhancing the engagement of said leg with the corresponding groove of the expansion cover.

4. The gasket of claim 1, and further comprising a side flange portion of the same flexible thermoplastic rubber as that of the central body portion overlying each of the side portions.

* * * * *